United States Patent [19]

Oster

[11] Patent Number: 4,844,420

[45] Date of Patent: Jul. 4, 1989

[54] RETRACTABLE CROWD CONTROL BARRIER

[76] Inventor: Nicholas R. Oster, 175 Birchwood Rd., Medford, N.Y. 11763

[21] Appl. No.: 209,172

[22] Filed: Jun. 20, 1988

[51] Int. Cl.[4] ..... E04H 17/00

[52] U.S. Cl. ..... 256/1; 49/34; 160/24

[58] Field of Search ..... 256/1; 160/24; 49/34

[56] References Cited

U.S. PATENT DOCUMENTS

| | | | |
|---|---|---|---|
| 376,436 | 1/1888 | Harrison | 160/24 |
| 3,220,464 | 11/1965 | Wise | 160/24 UX |
| 3,688,440 | 9/1972 | Appelgarth et al. | 256/1 X |
| 3,880,405 | 4/1975 | Brueske | 256/1 X |
| 3,917,231 | 11/1975 | Fink | 49/34 X |
| 4,124,196 | 11/1978 | Hipskind | 256/1 |
| 4,186,912 | 2/1980 | Byrd, Jr. | 256/1 |

*Primary Examiner*—Andrew V. Kundrat
*Attorney, Agent, or Firm*—Michael I. Kroll

[57] ABSTRACT

A retractable crowd control barrier is provided and consists of a housing carried on any type of post member in which an elongated tape is conveniently stored within the housing on a forward wound spring-actuated spool assembly and can be extended therefrom into a position to guide pedestrian traffic and maintain an orderly assembly of people.

3 Claims, 2 Drawing Sheets

RETRACTABLE CROWD CONTROL BARRIER

BACKGROUND OF THE INVENTION

1. Field of the Invention

The instant invention relates generally to extendable partitions and more specifically it relates to a retractable crowd control barrier.

2. Description of the Prior Art

Numerous extendable partitions have been provided in prior art that are adapted to include spring actuated mechanisms for retracting the partitions when not in use. For example, U.S. Pat. Nos. 4,124,196; 3,839,824; 2,961,255; 535,141; 376,436; 354,450 and 193,573 all are illustrative of such prior art. While these units may be suitable for the particular purpose to which they address, they would not be as suitable for the purposes of the present invention as heretofore described.

SUMMARY OF THE INVENTION

A primary object of the present invention is to provide a retractable crowd control barrier that will overcome the shortcomings of the prior art devices.

Another object is to provide a retractable crowd control barrier in which an elongated tape conveniently stored within the barrier housing can be extended therefrom to guide pedestrian traffic.

An additional object is to provide a retractable crowd control barrier which can be carried on any type of post member and readily extended into position to maintain orderly assembly of people.

A further object is to provide a retractable crowd control barrier that is simple and easy to use.

A still further object is to provide a retractable crowd control barrier that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
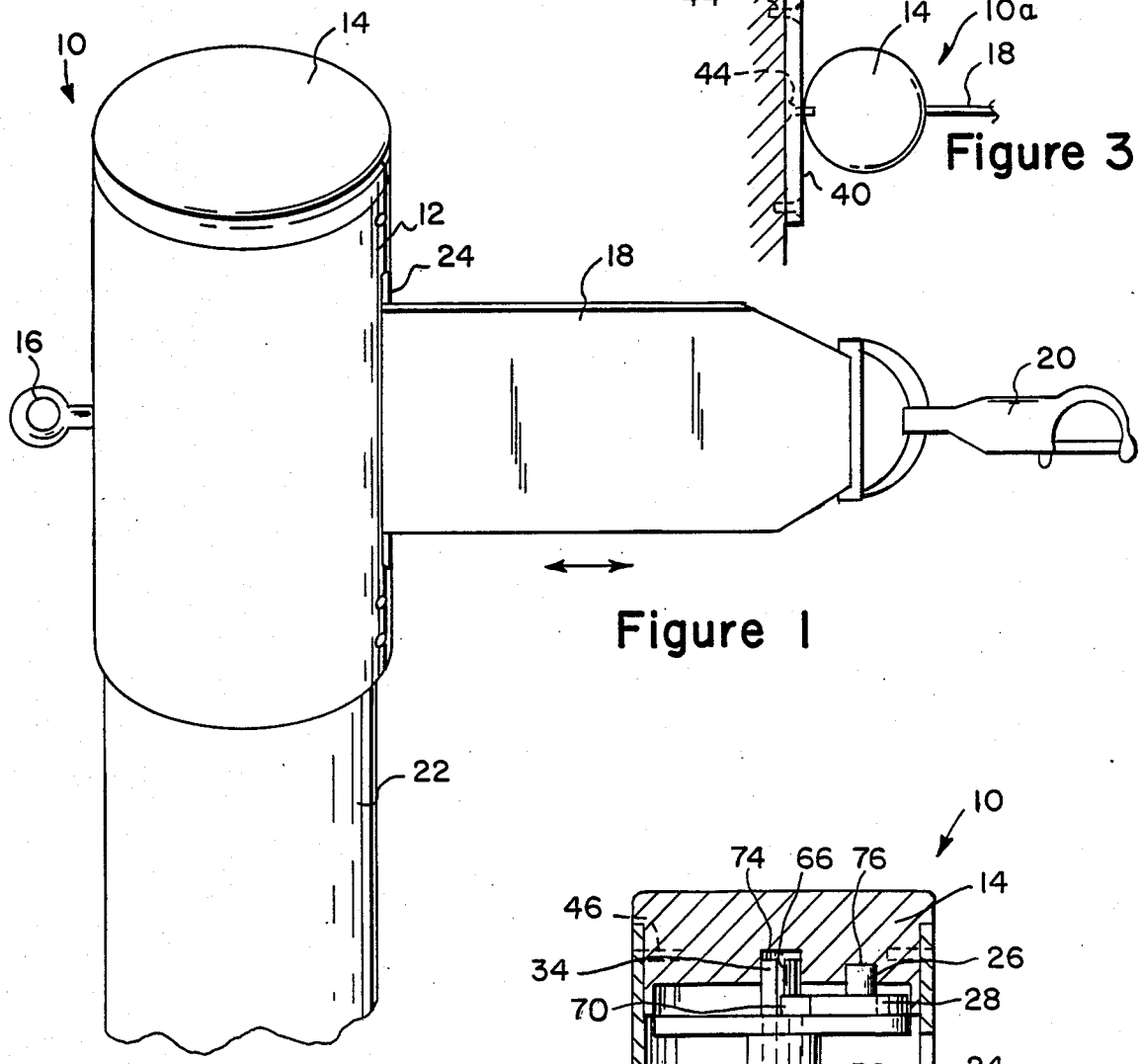
FIG. 1 is a perspective view of the invention.

Turning now descriptively to the drawings, in which similar reference characters denote similar elements throughout the several views, FIGS. 1, 2 2A and 4 illustrate a retractable crowd control barrier 10 consisting of a cylindrical housing 12 that has a vertical slot therein 24. A forward wound spring-actuated spool assembly 52 is rotatably mounted within the housing lengthwise thereof. A substantially elongated tape 18 of flexible material has a first end thereof secured to the spool assembly 52 and extends outwardly through the slot 24.

A clip member 20 is attached to second end of the tape 18 for releasably securing the tape 18 to a first stationary structure (not shown) and to prevent the tape 18 from completely passing into the housing 12 through theslot 24. An eyelet member 16 is affixed to the housing 12 opposite the slot 24 so that another clip member 20 can engage with the eyelet member 16.

An adapter member 36 is for attaching the housing 12 in a non-rotatably secured vertical position to a second stationary member. The adapter member 36 has a central threaded hole 50 extending upwardly from bottom thereof. The adapter member 36 is attached to bottom of the housing 12 with fasteners 46. In one instance the second stationary member is a hollow post member 22 which can be affixed thereto. In another instance the second stationary member is a solid post member **22*a* that has a threaded top portion 48 which can be threaded into the central threaded hole 50. The housing 12 may be routinely carried and rapidly erected with the tape 18** extended therefrom so as to guide pedestrian traffic and maintain orderly assembly of people.

The forward wound spring-actuated spool assembly 52 includes a base member 32 that has a central top recessed aperture 54 therein. A spool 30 with a central circular hub 56 has a vertical aperture 58 therethrough, a vertical slot 60 therein to hold the first end of the tape 18 and a transverse small aperture 62 through bottom end of the hub 56. A drive shaft 34 has a transverse small aperture 64 through bottom end and a top vertical slot 66 through top end thereof.

The base member 32 sits upon the adapter member 36, the spool 30 sits upon the base member 32 while the drive shaft 34 fits through the vertical aperture 58 in the hub 56 and into the central top recessed aperture 54 in the base member 32 so that the top vertical slot 66 in the top end will extend higher than top of the spool 30. A dowel pin 38 extends through the transverse small aperture 62 in the hub 56 and the transverse small aperture 64 in the drive shaft 34.

A flat forward wound spiral spring 28 is provided and has an outer hook end 70 which fits into the top vertical slot 66 in top end of the drive shaft 34, while a pin 26 fits into center 68 of the spring 28.

A top cap 14 is also provided and has a central bottom recessed aperture 74 and an offset bottom recessed aperture 76 thereion. The top cap 14 is attached to top of the housing 12 with fasteners 46, so that the central bottom recessed aperture 74 will fit onto top end of the drive shaft 34 while the offset bottom recessed aperture 76 will receive the pin 26 therein, the spring 28 will forward wind about the drive shaft 34 when the tape 18 is pulled out through the vertical slot 24 in the housing 12, thus normally setting the spring 28 to cause a winding action of the spool 30.

Figure 3:
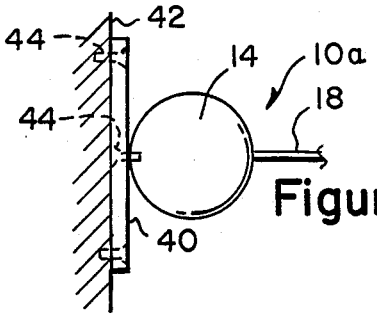
FIG. 3 is a top view of the invention being wall mounted.
Figure 2A:
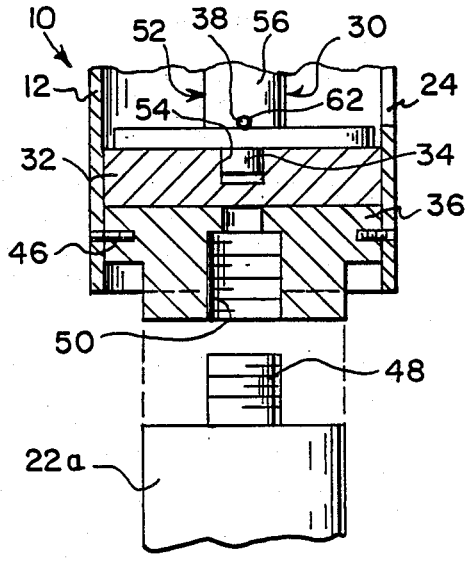
FIG. 2A is a vertical cross sectional view with parts broken away and another type of post disassembled therefrom.
Figure 2:
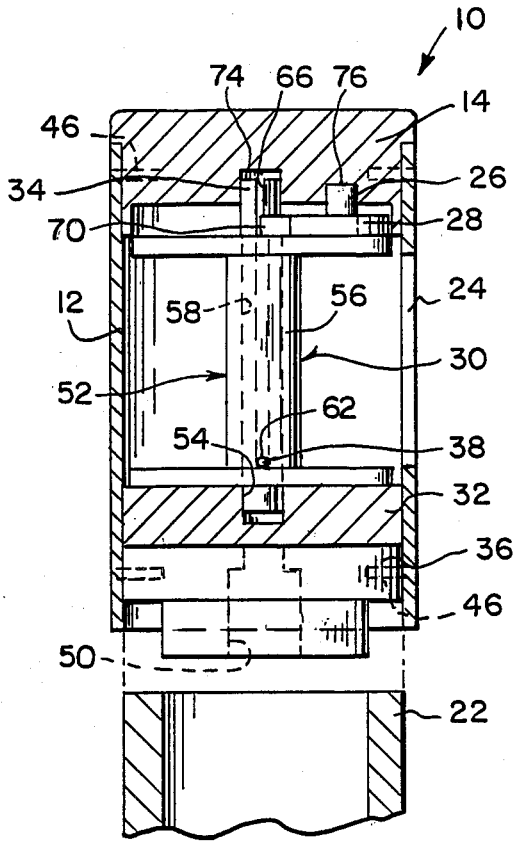
FIG. 2 is a vertical cross sectional view with the post disassembled therefrom.
Figure 4:
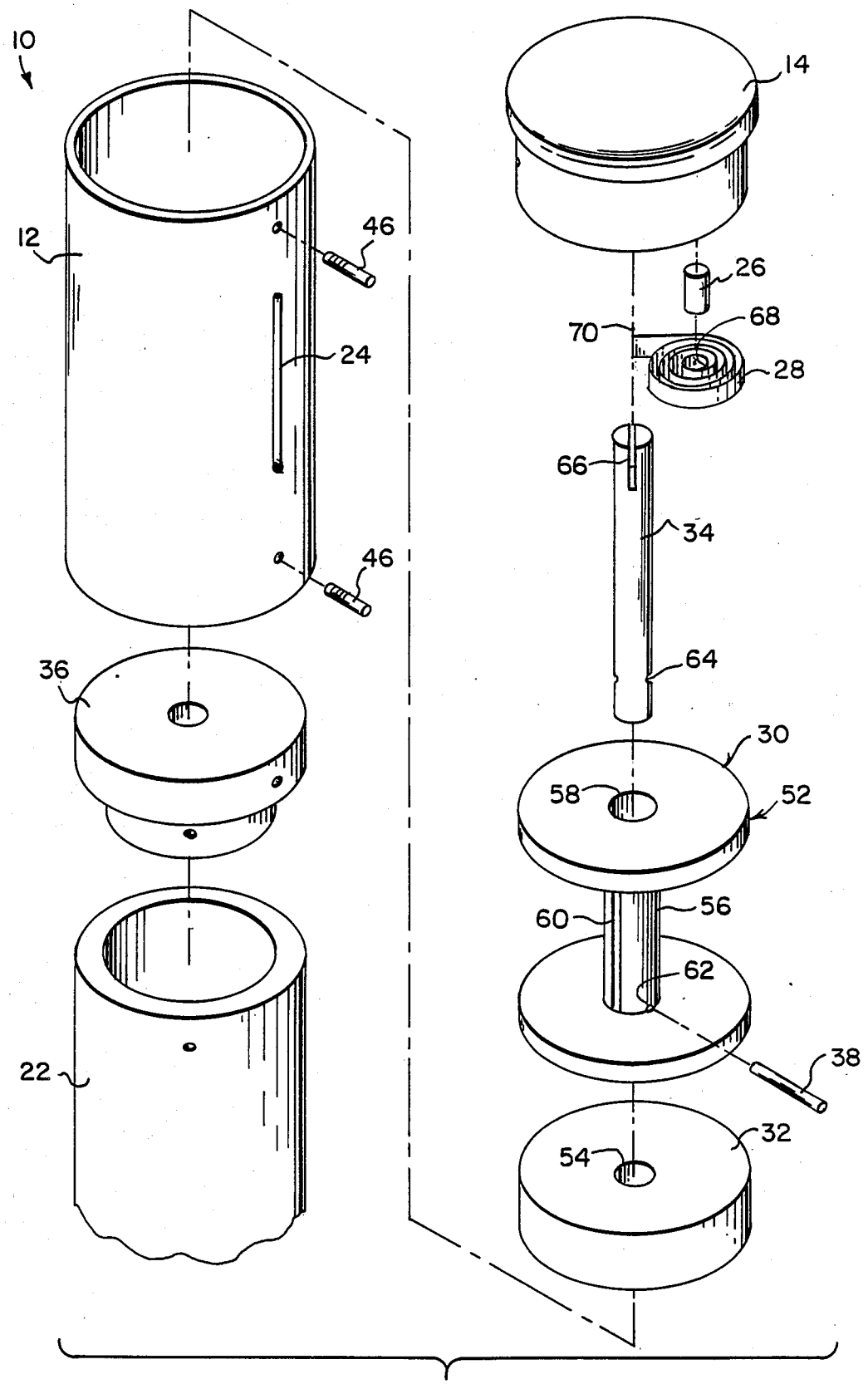
FIG. 4 is an exploded perspective view of the invention with the tape and clip removed therefrom.

FIG. 3 shows a modified retractable crowd control barrier **10*a* affixed to a wall 42 using a mounting bracket plate 40 and fasteners 44 attached thereto. In this way the posts 22 and 22a are eliminated and the housing 12 is directly connected to the mounting bracket plate 40**.

LIST OF REFERENCE NUMBERS

10 retractable crowd control barrier

**10*a*** modified retractable crowd control barrier

12 cylindrical housing
14 top cap
16 eyelet member
18 elongated tape
20 clip member
22 hollow post member
22a solid post member
24 vertical slot in housing
26 pin
28 flat forward wound spiral spring
30 spool
32 base member
34 drive shaft
36 adapter member
38 dowel pin
40 mounting bracket plate
42 wall
44 fastener
46 fastener
48 threaded top portion on solid post member
50 central threaded hole in adapter member
52 forward wound spring-actuated spool assembly
54 central top recessed aperture in base member
56 central circular hub in spool
58 vertical aperture in hub
60 vertical slot in hub
62 transverse small aperture in hub
64 transverse small aperture in drive shaft
66 top vertical slot in drive shaft
68 center of spring
70 outer hook end on spring
74 central bottom recessed aperture in top cap
76 offset bottom recessed aperture in top cap It will be understood that each of the elements described above, or two or more together, may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A retractable crowd control barrier comprising:

(a) a cylindrical housing having a vertical slot therein;

(b) a forward wound spring actuated spool assembly rotatably mounted within said housing lengthwise thereof;

(c) a substantially elongated tape of flexible material having first end thereof secured to said spool assembly and extending outwardly through said slot;

(d) a clip member attached to second end of said tape for releasably securing said tape to a first stationary structure and to prevent said tape from completely passing into said housing through said slot;

(e) means for attaching said housing in a non-rotatably secured vertical position to a second stationary structure, whereby said housing may be routinely carried and rapidly erected with said tape extended therefrom so as to guide pedestrian traffic and maintain orderly assembly of people; and (f) an eyelet member affixed to said housing opposite said slot so that another said clip member can engage with said eyelet member.

2. A retractable crowd control barrier as recited in claim 1, wherein said housing attaching means is an adapter member having a central threaded hole extending upwardly from bottom thereof, said adapter member attached to bottom of said housing so that in one instance the second stationary structure being a hollow post member can be affixed thereto and in another instance the second stationary structure being a solid post member having a threaded top portion can be threaded into said central threaded hole.

3. A retractable crowd control barrier as recited in claim 2, wherein said forward wound spring-actuated spool assembly includes:

(a) a base member having a central top recessed aperture therein, said base member sits upon said adapter member;

(b) a spool with a central circular hub having a vertical aperture therethrough, a vertical slot therein to hold the first end of said tape and a transverse small aperture through bottom end of said hub, said spool sits upon said base member;

(c) a drive shaft having a transverse small aperture through bottom end and a top vertical slot through top end thereof, said drive shaft fits through said vertical aperture in said hub and into said central top recessed aperture in said base member so that said top vertical slot in said top end will extend higher than top of said spool;

(d) a dowel pin extends through said transverse small aperture in said hub and said transverse small aperture in said drive shaft;

(e) a flat forward wound spiral spring having an outer hook end which fits into said top vertical slot in top end of said drive shaft;

(f) a pin which fits into center of said spring; and (g) a top cap having a central bottom recessed aperture and an offset bottom recessed aperture therein, said top cap is attached to top of said housing so that said central bottom recessed aperture will fit onto top end of said drive shaft while said offset bottom recessed aperture will receive said pin therein, in which said spring will forward wind about said drive shaft when said tape is pulled out through said vertical slot in said housing, thus normally setting said spring to cause a winding action of said spool.

* * * * *